US007096702B2

(12) United States Patent
McDonald

(10) Patent No.: US 7,096,702 B2
(45) Date of Patent: Aug. 29, 2006

(54) ADJUSTABLE MULTI-AXIAL ROLL FORMER

(75) Inventor: Daniel J. McDonald, Colbert, WA (US)

(73) Assignee: U.S. Rollformers, Spokane, WA (US)

( * ) Notice: Subject to any disclaimer, the term of this patent is extended or adjusted under 35 U.S.C. 154(b) by 233 days.

(21) Appl. No.: 10/456,227

(22) Filed: Jun. 6, 2003

(65) Prior Publication Data

US 2004/0244454 A1 Dec. 9, 2004

(51) Int. Cl.
*B21D 5/08* (2006.01)

(52) U.S. Cl. ..... 72/181; 72/226

(58) Field of Classification Search ..... 72/178, 72/181, 182, 226
See application file for complete search history.

(56) References Cited

U.S. PATENT DOCUMENTS

| | | | | |
|---|---|---|---|---|
| 1,673,787 | A * | 6/1928 | Frahm et al. | 72/178 |
| 2,471,490 | A | 5/1949 | Mercer | |
| 3,391,725 | A | 7/1968 | Yon | |
| 3,472,053 | A * | 10/1969 | Chang | 72/178 |
| 3,886,779 | A | 6/1975 | McClain | |
| 4,502,311 | A * | 3/1985 | Eibe | 72/206 |
| 4,899,566 | A * | 2/1990 | Knudson | 72/129 |
| 4,974,435 | A | 12/1990 | Vandenbroucke | |
| 5,107,695 | A | 4/1992 | Vandenbroucke | |
| 5,156,034 | A | 10/1992 | Lorbach | |
| 5,761,945 | A | 6/1998 | Vandenbroucke | |
| 5,787,748 | A | 8/1998 | Knudson | |
| 5,829,295 | A | 11/1998 | Voth | |
| 5,983,691 | A | 11/1999 | Voth | |
| 6,112,568 | A | 9/2000 | Lindstrom | |
| 6,148,654 | A | 11/2000 | Jensen | |
| 6,209,374 | B1 | 4/2001 | Bradbury | |
| 6,289,708 | B1 * | 9/2001 | Keinanen | 72/178 |
| 6,434,994 | B1 | 8/2002 | Bradbury | |
| 6,604,397 | B1 * | 8/2003 | Patty et al. | 72/178 |
| 6,766,676 | B1 * | 7/2004 | Gorski | 72/181 |

* cited by examiner

*Primary Examiner*—Daniel C. Crane
(74) *Attorney, Agent, or Firm*—Derek H. Maughan; Dykas, Shaver & Nipper

(57) ABSTRACT

A multi-axial roll-forming apparatus that is configured to be quickly and efficiently modifiable so as to allow the formation of a variety of differently shaped component pieces from a variety of different shaped pieces of material. A variously adjustable roll-forming device is held in a variety of vertical and horizontal orientations within a variously adjustable frame. The variously adjustable frame allows for various adjustments so as to provide an aperture consistent with the dimensions of the material being processed or the pieces which are to be formed.

20 Claims, 14 Drawing Sheets

ADJUSTABLE MULTI-AXIAL ROLL FORMER

BACKGROUND OF THE INVENTION

1. Field of the Invention

The present invention generally relates to metal roll-forming machines that are configured to form desired shaped pieces from sheets of metal material and more particularly to a multi-axially adjustable roll-forming machine that is multiply variously adjustable and capable of easy and rapid tooling configuration modifications to allow the production of formed pieces having a variety of different desired shapes and configurations, including pieces in stacked and assembled configurations.

2. Background Information

Shaped metal pieces are utilized in a large variety of consumer and industrial goods, including metal and formed metal pieces from roofing material to trusses, shelving, car parts, and home and garden devices. In order to obtain shaped metal pieces having a desired shape, metal can be pressed or bent. One way that this is done is through the process called press forming wherein a press brake applies a force to a sheet of metal material in order to form that material into a desired shape. One of the major disadvantages with this process is the time involved in obtaining a number of such pieces, since each piece must be pressed and formed.

Another type of forming method that is used particularly when longer pieces are to be formed, is called roll-forming. Roll-forming involves forming pieces by feeding a sheet of material, usually a form of sheet metal, through a series of rolling apparatuses, which sequentially exert bending forces upon the material so as to deform the material and attain the desired profile for the piece. This method works very well if all of the pieces are generally the same width, the same thickness or gauge, and will be formed into generally the same shape or family of shapes.

However, when variations in width, gauge or desired shape occur, the configuration and set up of the roll-forming components must be rearranged to accommodate for these changes. In some situations, the machinery involved is simply incapable of any modification that would be sufficient to bring about these changes. Therefore, new machinery or roller components must be brought in or changed out. This can be a tremendously expensive and a time-consuming ordeal. In other situations, machinery can be modified to achieve the desired result. However to do so requires a substantial amount of time and requires that production of the pieces be stopped while the changeover takes place. As a result of this general inflexibility, most roll-forming machines are limited to primarily forming one or two parts or shapes of a group of pieces or to be uniquely set up for the production of high volumes of one particularly shaped part.

Therefore what is needed is a roll-forming device that provides simple and efficient configuration modification so as to accommodate a variety of shaped and dimensioned pieces and to form these pieces into a variety of desired shapes oriented in a variety of positions. Such a device would allow an operator to variously adjust the receiving aperture portion of the device to provide for variations in the width of the materials to be formed and the thickness of the material. What is also needed is a roll-forming device that has adjustably selectable roll-forming portions that allow an operator to selectively vary the shape and orientation of pieces that are created and formed within the device. What is also needed is a device that accomplishes the aforementioned aims and which is configurable for automatic configuration modification.

Therefore, it is an object of the present invention to provide a roll-forming device that provides simple and efficient configuration modifications so as to account for variations in widths of materials to be formed, thickness of material to be formed, and/or to vary the shape of pieces to be formed. Another object of the present invention is to provide a roll-forming device that is easily and quickly adjustable thus allowing a greater variety of pieces to be formed than those that can be formed with the devices that currently exist in the prior art. Another object of the invention is to provide a roll-forming apparatus that provides increased bending capabilities. Another object of the present invention is to provide a roll-forming apparatus that produces automatically stacked pieces, which increases the efficiency of the roll-forming apparatus and eliminating the need for the purchase of an additional stacking machine. Another object of the present invention is to provide such a device that is capable of automatically varying the length of all defined areas of the components either manually or automatically. Another object of the present invention is to provide a device that provides all of the above-stated objects and is economical to manufacture, flexible in operation and set up, and affords ease of operation, maintenance, and set up.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a multi-axial roll-forming apparatus that is configured to be quickly and efficiently modifiable so as to allow the formation of a variety of differently shaped component pieces from a variety of different shaped pieces of material. The present invention is comprised of a plurality of variously adjustable roll-forming devices that are held in a variety of vertical and horizontal orientations within a variously adjustable frame. The variously adjustable frame also holds a plurality of drive rollers in adjustably variable positions. These drive rollers and roll-forming portions define an aperture that is selectively adjustable so as to be modifiable to accommodate raw pieces of material having various horizontal, vertical, and longitudinal dimensions and allow these items to be inserted into the device. The metal forming portions of the device are adjustably connected to drive rollers that engage portions of sheets of material and pass this material through the device and past the adjustable roll-forming devices.

The adjustable roll-forming devices are adjustably selectable so as to allow a user to selectably vary the desired roll-forming tool to be utilized to achieve a desired result. The adjustable roll-forming assemblies are also vertically adjustable so as to provide a desired formation result even when the frame portion of the device is vertically modified so as to allow for variations in the gauge of the material being passed through the roll-forming assembly. The various modifications of the frame, roll-forming devices, and the associated pieces and parts can be modified manually or mechanically, including through an automated system.

In one embodiment of the present invention, the roll-forming assemblies are made up of at least one roll-forming device such as an idler roller, which is connected to an adjustable shaft assembly. The adjustable shaft assembly is made up of at least two parts and is configured to attach with several roll-forming devices at a variety of orientations and positions. The adjustable shaft assembly is configured to allow the forming roll to be alternatively engaged and disengaged from contact with a piece of material. In some embodiments, more than one forming roll may be placed upon such an adjustable forming roll assembly. Thus enabling the adjustable forming roll assembly to be variously configured to form pieces having various characteristics and configurations. In one such embodiment, the roll-forming assembly may be variously altered so as to allow contact between the first forming roll and a piece of material when the roll-forming assembly is positioned in a first orientation. The roll-forming assembly may also be variously altered so as to allow contact between a second forming roll and a piece of material when the roll-forming assembly is positioned in a second orientation. By changing the positioning of the roll-forming assembly, the contact portion of the device may be variously modified to form pieces of material into various shapes and orientations. In some configurations, the various contacting members and roll-forming devices can be variously configured so as to allow multiple forming configurations to be achieved through modification from a single location, or by the altering of a single device such as a handle.

In some embodiments, the adjustable shaft assembly may also be configured to be sliding, telescoping or otherwise vertically adjustable so as to allow the roll-forming devices to be alternatively positioned in desired orientations, positions, and locations. Such an adjustable shaft assembly maintains the first and second roller assemblies in a desired position and orientation regardless of the gauge or thickness of the material being processed through the device. This allows uniform bends to be made in the material as it is processed through the device and increases the versatility and precision of the invention of the pieces that are formed in the device.

In other embodiments of the same invention, the adjustable shaft assemblies can be locked or held in place by a clamp, key or other similar device. Such a configuration reduces the amount of arbor deflection and allows the dimensions of the materials used in the device to be reduced because of the decreased amount of strain involved.

In one embodiment, the first roll-forming device is configured to deform a piece of material in a first direction and the second roll-forming device is configured to deform a piece of material in a second direction. Selectively pivoting the adjustable shaft allows either the first or second of the roll-forming devices to come into contact with the material. Once the adjustable shaft has been oriented to a selected position, it is held in a rotatably secure position by a locking device that prevents the shaft from rotating when the roll-forming devices are brought into contact with the material. In other embodiments, the shaft may be variously embodied to include a variety of other roll-forming pieces and configurations, including configurations where the various roll formers are themselves comprised of other variable tools.

Various methods for positioning the adjustable pivotable shaft exist. In one embodiment, the shaft may be adjusted by simply manually pivoting the adjustable pivotable shaft so as to vary the orientation of the roll-forming pieces. In another embodiment, the device is adapted for automatic variation by a moving portion such as a mechanical, hydraulic or pneumatic device. In one example of such an embodiment, the adjustable shaft assembly is rotatably secured to a sprocket by a device such as a key. The sprocket is configured to be maintained in connection with a movement creating portion of the device, whereby movement of the moving portion moves the sprocket thus pivoting the adjustable shaft and changing the forming roll that will contact the material. In other embodiments of the invention, locking devices such as pawls, pins, keys, and other locking devices may also be variously embodied and utilized.

The vertical and horizontal positioning of the roll-forming assemblies can be variously altered so as to provide a variously modifiable aperture that can accept pieces of material of various shapes, widths, sizes, and thicknesses into the device. The roll-forming assemblies and the adjustable shafts are suspended upon a frame that is comprised of a pair of parallel arbors vertically suspended upon a pair of horizontally adjustable stanchions. The arbors are connected to a motor and are configured to drive a pair of drive rollers in a desired direction so as to engage material and push this material through the device. The roll-forming assemblies and the drive rolls are selectively adjustably positioned horizontally along the arbors and are held in these desired positions by a securing device. The vertical arbors are vertically adjustable so as to allow a variety of different configurations to be selected. A horizontal roll-forming control device allows the roll-forming assemblies to extend toward a central portion of the arbors and to retract away from the central portion of the arbors. The combination of dually horizontally adjustable portions and dually vertically adjustable arbors allow the aperture for receiving material to be variously modified to accommodate a wide variety of types of materials.

In use, material is fed through an aperture by a pair of drive rollers that are positioned along each of the two arbors. These drive rollers engage the material and the material is forced against the forming rollers in the roll assembly. As the material passes the forming roller, the rollers deform the material so as to achieve a desired shape. The width and height of the apertures and the configuration of the roll-forming portions can all be variously selectively modified to produce a variety of desired shaped pieces. Furthermore, the present invention provides an embodiment wherein varying the configuration can be performed simply, and quickly by either manual or automated devices so as to obtain a variety of desired shaped pieces and results.

The present invention provides a roll-forming apparatus that is simply and efficiently modifiable so as to account for variations in the widths and gauges of the materials utilized in the roller and to variously alter the shapes of the pieces being formed. The present invention allows for quick and efficient modifications that allow material passing between the rollers to be bent inward to form lips or outward to form components such as stiffeners, steps, hats, caps, troughs, and C-sections. This invention, with its various adjustments, is well suited for precise and repeatable manufacturing of such sectional components. The ability of the idler rollers to move in a vertical direction when the arbors are adjusted in a vertical direction also provides increased downward bending capabilities and increases precision in bending materials into desired shapes.

The present invention also allows a method of roll-forming to be utilized wherein individual rollers and/or gangs or groups of roller assemblies can be modified and varied to quickly change the positioning and bending configurations of the device so as to form alternatingly dimensioned pieces and parts. Such a device is economically more advantageous because such a device allows the efficiencies that exist in roll-forming processes to be utilized to form a variety of types of pieces upon a scale which was not efficient or viable under the prior art. Such a device also allows for the formation of pieces that are alternatively positioned and directed to be directed upward and then downward and to come off the roll-forming assembly in a generally stacked orientation. In some embodiments of the invention, attachments may be configured to connect with the variously adjustable roll-forming assemblies so as to allow the combination to form and assemble pieces as well as to form and stack pieces of material as they are produced. Such embodiments forego the needs for additional machinery or manual processing because this invention allows all of these elements to be accomplished by the same invention or device.

The purpose of the foregoing abstract is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

BRIEF DESCRIPTION OF THE DRAWINGS

FIG. 12 A is a detailed view of the embodiment shown in FIG. 12 is use in conjunction with the straightener device shown in FIG. 11.

DESCRIPTION OF THE PREFERRED EMBODIMENTS

Figure 1:
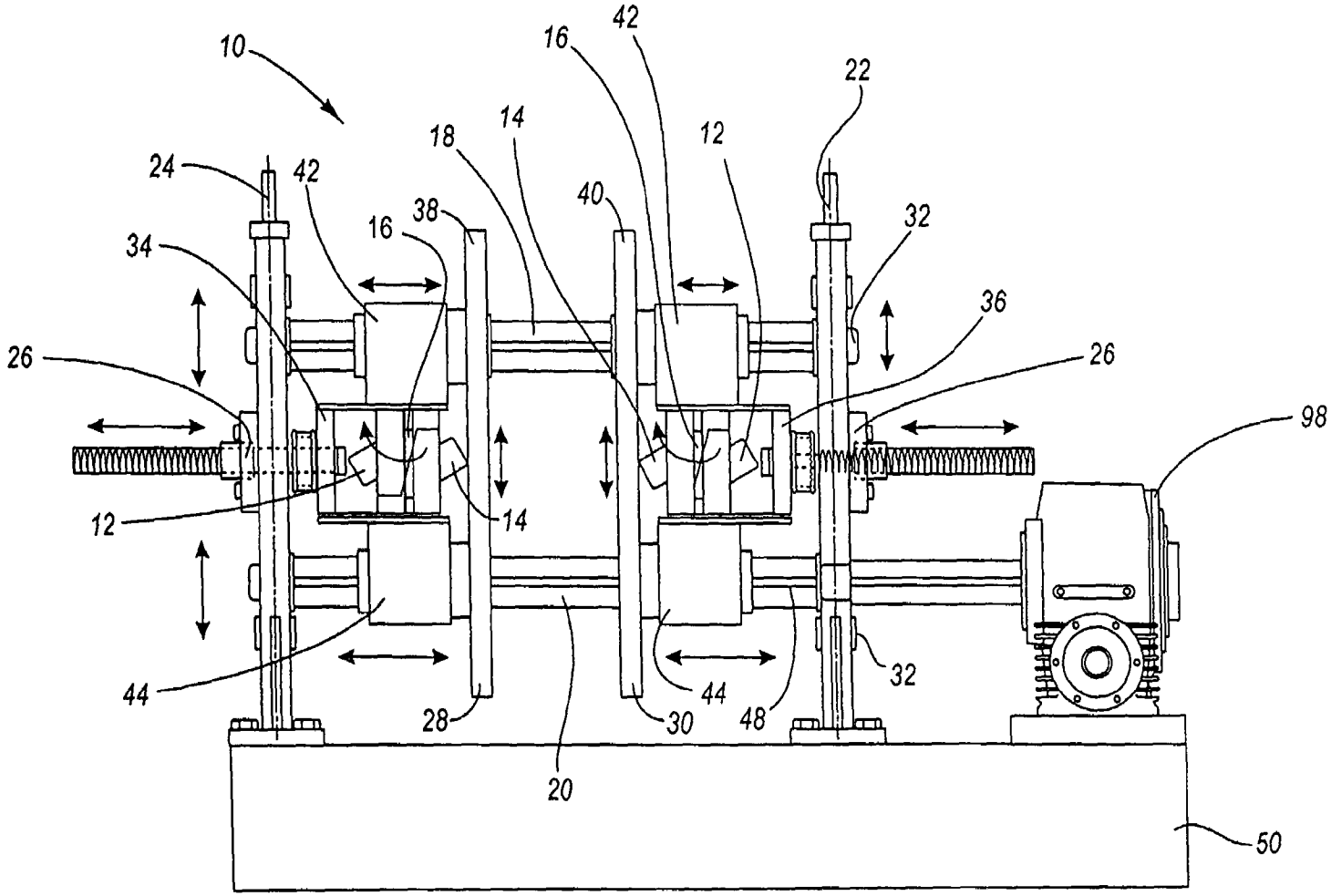
FIG. 1 is an end view of one preferred embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
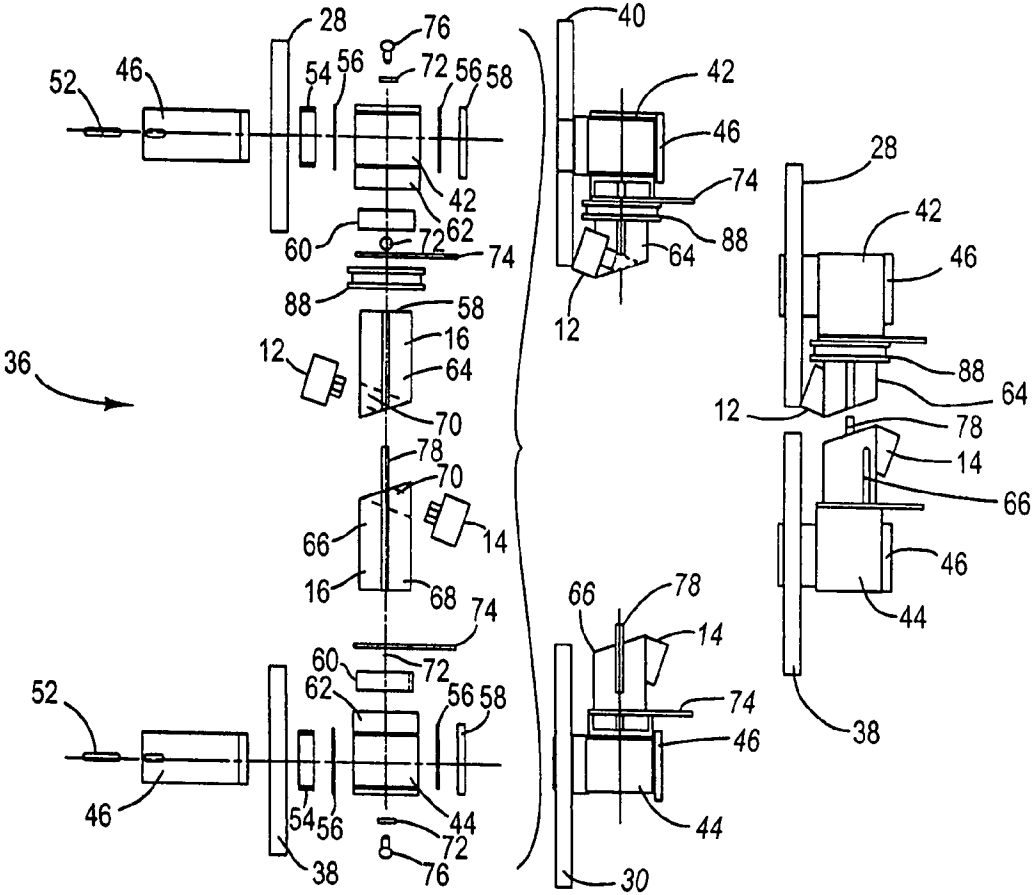
FIG. 2 is a detailed assembly view of one of the roll-forming assemblies of the embodiment shown in FIG. 1.
Figure 3A:
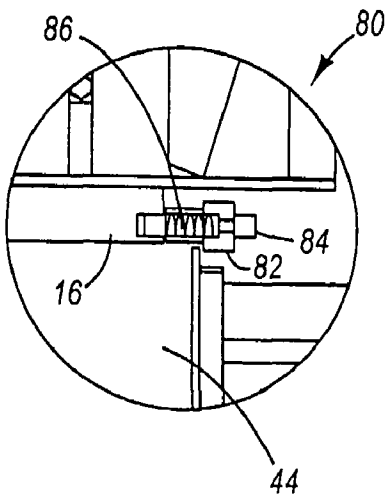
FIG. 3A is a detailed view of a portion of the invention shown in FIG. 3.
Figure 3:
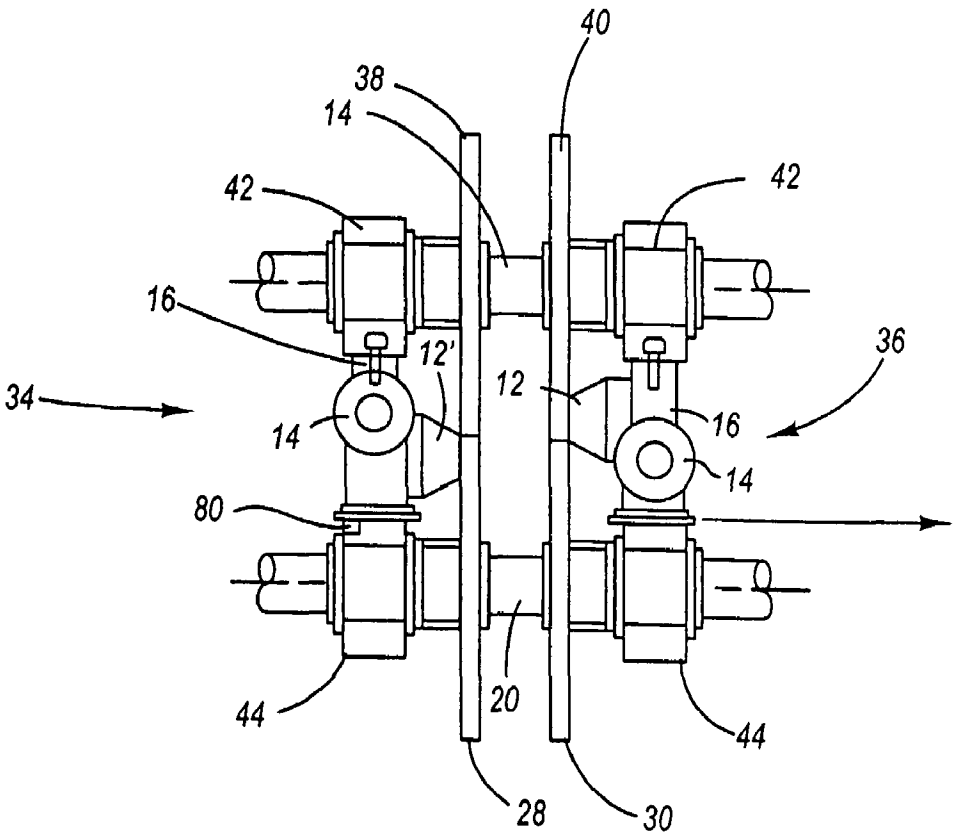
FIG. 3 is a detailed end view of the roll-forming assemblies shown in FIGS. 1 and 2.
Figure 4:
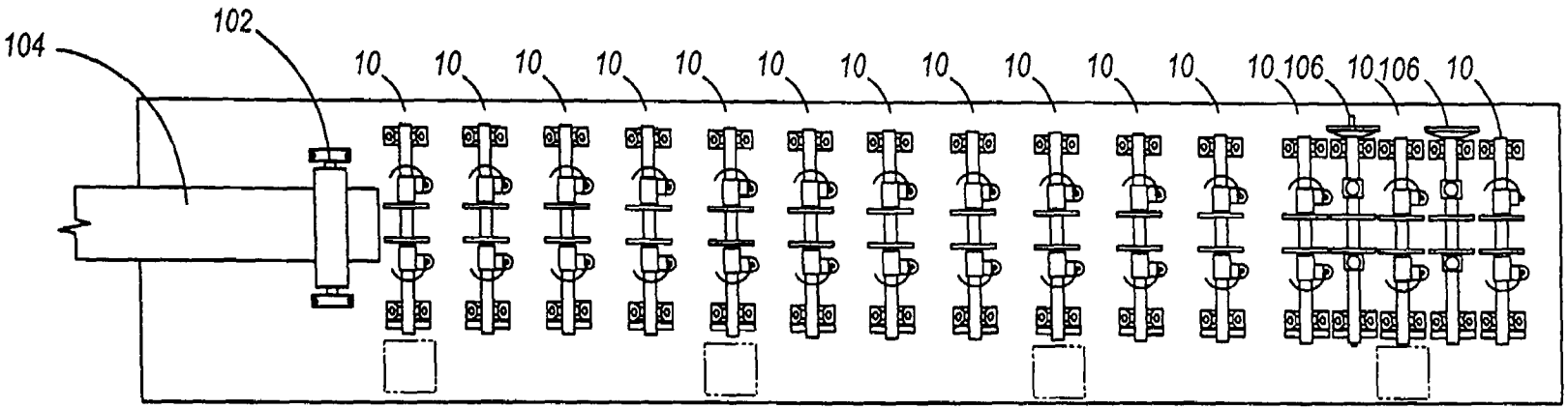
FIG. 4 is a top plan view of a plurality of the embodiments shown in FIGS. 1, 2 and 3 in a roll-forming assembly configuration.
Figure 5:
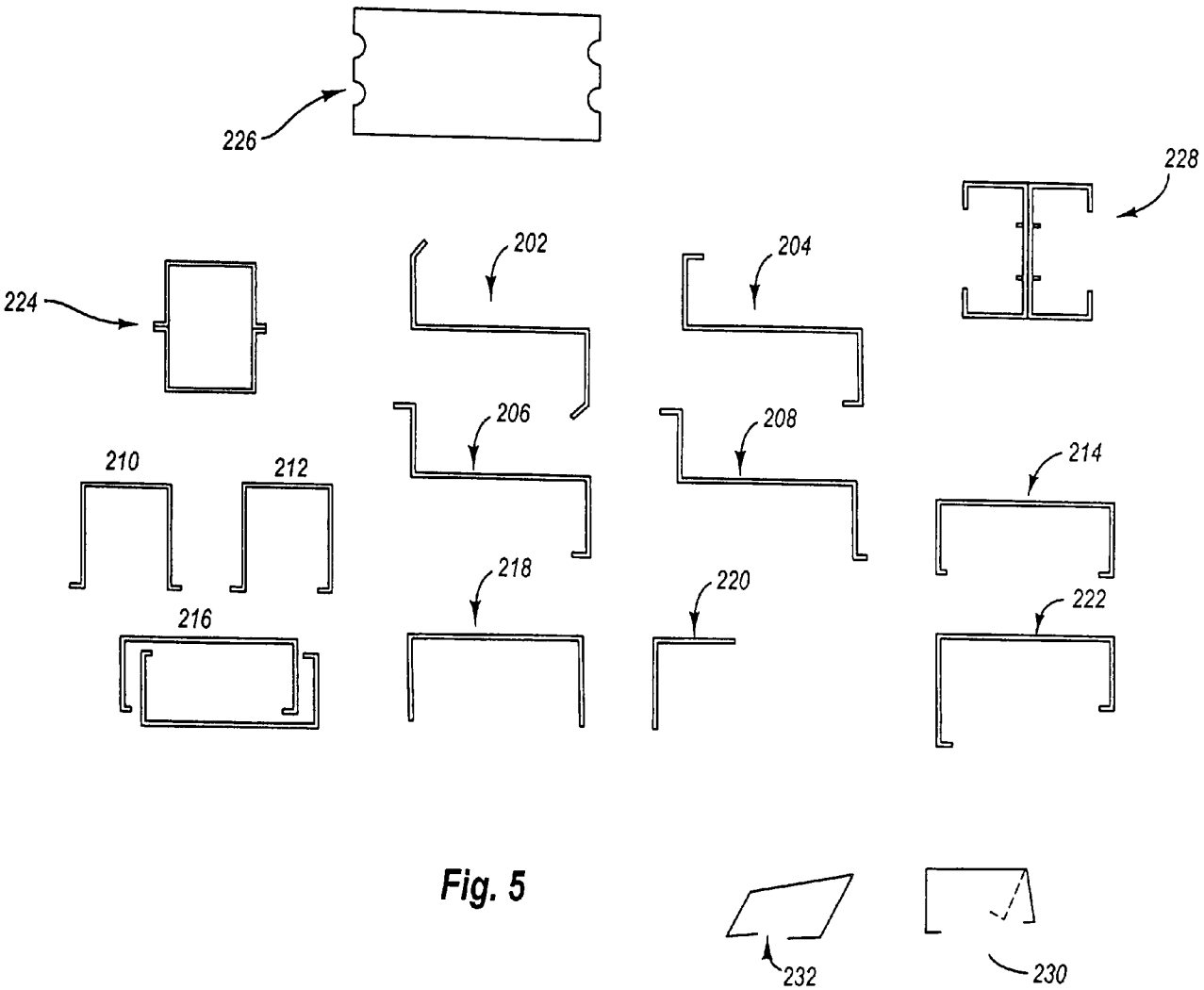
FIG. 5 is a view of a plurality of cross sectional profiles of a variety of pieces which embodiments were created on the apparatus in accordance with the present invention.

FIGS. 1–11 show a variety of embodiments and features of the present invention. The present invention is a multi-axial roll-forming device that is variously selectively adjustable so as to be able to form a variety of desired selected pieces from sheets of material passing there through. A first preferred embodiment of the present invention is shown in FIG. 1. FIG. 1 shows a multi-axial roll-forming apparatus 10. This apparatus 10 may be variously combined with other roll-forming devices to variously from desired shaped pieces from sheets of material. FIG. 4 shows a top view of an assembly of the present invention shown in FIG. 1 in an assembly type set up. As will be discussed later, variations in the individual features of the roll-forming apparatuses, as well as the placement and organization of these individual roll-forming assemblies, can create a variety of variously formed pieces as are shown in FIG. 5.

Referring now to FIG. 1, the multi-axial roll-forming device 10 is made up of a pair of roll-forming assemblies 34, 36. Each of these roll-forming assemblies 34, 36 are held in a desired vertical orientation by suspension upon a pair of arbors 18, 20. The vertical positioning of these arbors 18, 20 may be varied by adjusting the yokes 32 that hold the arbors 18, 20 in designated orientations and positions. The horizontal positioning of the roll-forming assemblies 34, 36 along the upper 18 and the lower arbors 20 are controlled by horizontal positioning devices 26. The roll-forming assemblies are horizontally connected to pairs of drive rollers 28, 30, 38, 40 that engage and move material to be formed through the forming devices 34, 36.

The arbors 18, 20 are supported upon a pair of stands or stanchions 22, 24 that, depending upon their position relative to the positioning of the motor assembly 98, may be referred to as the inboard stand 22 and the outboard stand 24. Typically, the inboard stand 22 is the stand located closest to the motor or force driving mechanism 98. These stands 22, 24 are each configured to receive and support an upper arbor 18, a lower arbor 20, and a horizontal positioning device 26 there through. In one of the preferred embodiments of the invention, the stands 22, 24 are configured so as to be generally horizontally adjustable along a base plate 50. The upper arbor 18 is supported within an adjustable yoke 32 that allows for generally vertical movement of the drive rollers 38, 49 and the portions of the roll-forming assemblies 34, 36 that are connected to the upper arbor 18. While in this preferred embodiment, the yoke 32 is connected to both the upper arbor 18 and the lower arbor 20. However, it is to be distinctly understood that the positioning of the yoke 32 is not limited thereto, but may also be variously embodied to connect either the lower arbor 20, or the upper arbor 18 alone. In some other embodiments, the upper arbor 18 may be held in a relatively fixed position and the yoke 32 which is attached to the lower arbor 20 may be moveable to raise and lower the lower arbor 20 into and out of a variety of desired positions and orientations.

The roll-forming assemblies 34, 36 are held in a slideable horizontal connection with the upper 18 and lower 20 arbors by upper 42 and lower 44 sliding blocks. These upper and lower sliding blocks 42, 44 each contain a slideable sleeve (shown in FIG. 2) that can be adjustably secured thus allowing for the driving rotation of the upper 18 and lower 20 arbors to be transmitted to the driving rolls 28, 30, 38, 40 as well as allowing for the horizontal movement of the roll-forming assemblies 34, 36 and the driving rolls 28, 30, 38, 40 along the upper 18 and lower 20 arbors. The vertical and horizontal positioning of the drive rollers 28, 30, 38, 40 and the roll-forming assemblies 34, 36 can be varied to accommodate pieces of material having a variety of sizes, shapes, and characteristics.

The drive rollers 38, 40 that are connected to the upper arbor 18 and the driving rollers 28, 30, which are connected to the lower arbor 20, are configured to releasably securely connect with the arbors 18, 20. A first drive roll 28 and a second drive roll 30 are each slideably connected to the lower arbor 20. A third drive roll 38 and fourth drive roll 40 are slideably connected to the upper arbor 18. The first drive roll 28, the second drive roll 30, the third drive roll 38, and the fourth drive roll 40 are each movingly engaged with the motor 98 through the arbors 18, 20, which act as axles to engage and drive the drive rolls 28, 30, 38, 40. In the preferred embodiment, the third and fourth drive rolls 38, 40 are configured to turn in a generally counterclockwise direction, while the first 28 and second 30 drive rolls are configured to turn in a generally clockwise direction. This variation causes the drive rolls 28, 30, 38, 40 to turn towards one another and to pull pieces of material through the device 10 and through the forming assemblies 34, 36. These forming assemblies 34, 36 are configured to rotate to vary the roller device 12, 14 that will contact the material passing there through and in so doing alter the shape of the resulting piece. The forming assemblies 34, 36 are also configured so as to allow the forming roller devices 12, 14 to be vertically adjustable so as to place the roller devices 12, 14 in a desired orientation, location, and position when the arbors 18, 20 are vertically adjusted to accommodate a piece of material having a desired thickness.

Depending upon the necessities and desires of the user, a variety of configurations may be utilized to hold the drive rollers 28, 30, 38, 40 and the upper and lower sliding blocks 42, 44 in a desired orientation and position with regard to the roll-forming assemblies 34, 36. In addition, the roll-forming assemblies 34, 36 may be variously configured. The following description, therefore is intended to be seen as illustrative in nature and not as limiting.

FIG. 2 shows a detailed assembly view of the second roll-forming assembly 36 shown in FIG. 1. In this assembly, a pair of upper and lower drive rollers 28, 38, upper and lower sliding blocks 42, 44, and one roll-forming assembly 36 are shown. While the preferred embodiment comprises an additional opposing pair for all of these features as shown in FIG. 1, the configuration of the opposing features are substantially similar to the structure shown in this description. FIG. 2 shows a slideable sleeve 46 that is configured to pass through a drive roll, 28, 30, 38, 40. This sleeve 46 is also configured to surround an arbor 18, 20 and to fit with an upper or a lower sliding block 42, 44. The spacing and positioning of the slide block 42, 44 between the drive rolls 28, 30, 38, 40 is accomplished by placing spacers 54, shoulders, or thrust bearings against a journaled bearing 60 that is positioned within the sliding blocks 42, 44. These pieces 54, 56, 60 are held together in a desired position by a lock nut 58. This configuration allows the rolling assemblies 34, 36 and the drive rollers 28, 30, 38, 40 to be held in relatively precise locations during the formation of pieces from material passing through the device 10.

The sleeve 46 is then keyed both to the arbors 18, 20 and to the drive rolls 28, 30, 38, 40. In as much as the arbors are connected to the motor device 98, keying the sleeve 46 to both an arbor 18, 20 and a drive roll 28, 30, 38, 40 causes the drive rolls 28, 30, 38, 40 to rotate in a desired direction as moved upon by the arbor 18, 20. The sleeve 46 is configured to fit within the sliding blocks 42, 44. The blocks are configured to allow the sleeve 46 and the arbor 18, 20 to rotate relatively freely within sliding block 42, 44. To facilitate this rotation, bearings or other friction reducing devices are placed within the sliding blocks 42, 44.

The sliding blocks 40, 42 are each configured to have shaft receiving portions 62 that are configured to connect the adjustable pivotable shaft 16 with the sliding blocks 42, 44. A journaled bearing 60 is placed within the bottom portion of the upper sliding block 42. An example of such a journaled bearing is a bearing referred to as a GARLOCK® bushing. Another journaled bearing or bushing 60 is likewise placed within a top portion of the lower sliding block 44. An attachment portion of the horizontal positioning device 74 is then placed in a desired position. This attachment portion 74 of the horizontal positioning device 26 is configured to allow passage of a portion 64, 66 of the adjustable shaft there through. In the lower sliding block 44, a portion of the lower adjustable shaft 66 is then received in to a shaft-receiving portion 62. This lower adjustable shaft portion 66 is held in a pivotable position within the lower shaft by a carriage bolt 76 that prevents the lower portion 66 of the adjustable shaft portion 16 from being extended upward when the roll-forming assembly 36 is moved in a vertical direction.

The upper portion 64 of the adjustable shaft 16 is connected through a portion of the horizontal positioning device plate 74 to a shaft receiving portion 62 of the to the upper sliding block 42. The taped end 68 of the upper portion 64 of the adjustable shaft is configured for placement against a journaled bearing or bushing 60, which is also configured to fit within the shaft-receiving portion 62 of the upper sliding block 42. The upper portion 64 of the adjustable shaft 16 is connected to the upper sliding block 42 through a carriage bolt 76 that holds the upper portion 64 of the adjustable pivotable shaft 16 in a desired vertical position and orientation with regard to the upper sliding block 42. In this preferred embodiment, a sprocket 88 is fixedly attached to the upper shaft portion 64. This sprocket 88 is configured to operatively connect with a motive device that selectively rotates the sprocket 88 so as to vary the position of the adjustable pivotable shaft 16. In so doing, the position of the various forming roll devices contact the piece of material passing through the forming aperture.

While in this embodiment a sprocket is shown, it is to be distinctly understood that the invention is not limited thereto but may be variously embodied to perform the selective rotation of the pivot shaft 16 in a variety of ways. In addition to facilitating the rotation of the adjustable pivotable shaft 16, the sprocket 88 also serves as a means for preventing the adjustable pivotable shaft 16 from rotating from a desired position when the roller portions 12, 14 are contacted by a piece of material that is passing there through.

The upper and lower shaft portions 64, 66 each have a taped portion 68 and a keyed portion 70. The taped portions 68 are configured to maintain connection with the thrust bearings 60 that are located within the sliding blocks 42, 44. In the preferred embodiment, thrust washers 72 are also placed between the connection of the upper 64 and lower 66 portions of the adjustable pivotal shaft and the bearings 60 so as to assist in allowing the upper and lower portions to pivot or rotate freely about the connections with the carriage bolts 76.

The shaft lower portion 66 is configured to engage and hold a post 78 therein. This post 78 is configured to extend from a portion within the shaft lower portion 66 up through the keyed portion 70 of the shaft upper portion 64 and into the body of the shaft upper portion 64. The key post 78 and the upper 64 and lower 66 portions of the adjustable pivotable shaft 16 are configured to allow the upper 64 and lower 66 portions of the shaft 16 to be seated in a desired arrangement and for the upper portion 64 of the adjustable shaft to rise along this post 78, when desired. As the upper arbor 18 is raised, the upper portion 64 of the adjustable shaft 16 will rise and slide along the post 78, while the lower portion 66 of the adjustable shaft 16 will remain in its original position. This sliding or telescoping feature allows the positioning of the roll-forming pieces 12, 14 to adjust vertically as the thickness or gauge of the material being passed there through is altered. This feature also allows the roll-forming devices 12, 14 to be maintained in the same general orientation and position with regard to the material passing through and for the pieces being formed from this material to have the same general shape regardless of the thickness of the material being utilized.

In other embodiments, a key can be placed within the post 78. This key then holds the upper portion 64 and the lower portion 66 together in a desired position whereby the upper and lower portions 64, 66 will not separate when acted upon by a force. In addition to the key, a clamping type device, a wedge or dovetail formed portion may also be included. Such a configuration prevents so-called arbor deflection or the raising and lowering of the arbors as the yield of the materials passing through are varied. By reducing this effect, the dimensions of the pieces of the device can be reduced thus allowing for not only reduced costs in manufacture but also for increased efficiencies and the ability to from smaller pieces without any loss in the structural integrity of the device.

The upper and lower portions 64, 66 of the adjustable pivotable shaft 16 are each configured to receive a roll-forming device 12, 14. In this preferred embodiment, the roll-forming devices 12, 14 are idler rollers that are placed in a variety of generally vertically angled positions so as to form a piece of material having desired characteristics. While in this embodiment two roll-forming devices 12, 14 are shown, it is to be distinctly understood that the invention is not limited there to but may be variously embodied to contain a variety of numbers of forming devices, not limited to the type, number or orientation shown in this embodiment.

The present invention is most notable in that it allows the pieces of material to be formed in nearly any orientation or direction, including any vector angle within 180 degrees of horizontal. The roll-forming devices 12, 14 are positioned at various angles according to the necessities of the user. In this preferred embodiment, a first roll-forming device 12 is attached to the upper portion 64 of the adjustable shaft and a second roll-forming device 14 is attached to the lower portion 66 of the adjustable shaft.

Figure 12:
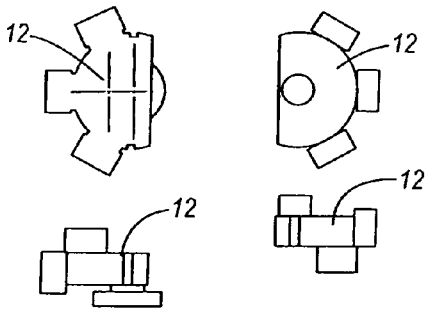
FIG. 12 shows detailed top bottom and side plan views another embodiment of a forming roll assembly 12, 14.
Figure 12A:
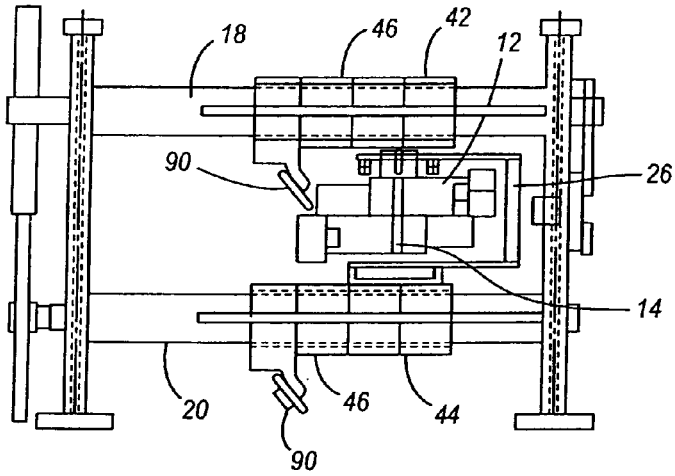

The roll-forming devices 12, 14 are idler rollers in this case that are placed along the shaft in such a manner whereby when the first roll-forming device 12 is in contact with a piece of material, the second roll-forming device 14 is not in contact with a piece of material, and vice-versa. The shaft 16 is adjustably pivotable so that by pivoting the orientation of the shaft 16, the forming roller, which will contact the material, is switched from a first roller 12 to a second roller 14, and, if so desired, from the second roller 14 back to the first roller 12. This pivoting capability allows the device to be quickly modified so as to be configured into a variety of different positions and orientations for forming desired shaped pieces from a sheet of material. In addition to the types of forming rollers shown in this figure, a variety of other types of devices can likewise be utilized. These include those devices wherein the first and second forming rollers 12, 14 are additionally made up of a variety of other types of rollers formed at varying angles and having varying forming characteristics. An example of such an embodiment is shown in FIGS. 12 and 12A.

In the preferred embodiment, the selective rotation of the adjustable pivotable shaft is accomplished by the rotation of a sprocket 88. This sprocket 88 is also configured to hold the adjustable pivotable shaft 16 in a desired position when material is forced against the rollers 12,14 during the part forming process. In another embodiment, a locking device 80 is configured to hold the adjustable pivotable shaft in a desired location. Such an embodiment is shown in FIGS. 3 and 3A.

FIGS. 3 and 3A show an embodiment of the invention wherein the adjustable pivotable shaft 16 is prevented from rotation by a locking mechanism 80. This locking mechanism 80 (shown in FIGS. 3 and 3A) holds the pivot shaft 16 in place and prevents the forming rolls 12, 14 from moving when such movement is not desired. While the following description will describe the use of such a locking device in conjunction with a manual rotation method, it is to be distinctly understood that the invention is not limited thereto but may be variously embodied to be utilized in conjunction with a variety of mechanical adjusting device. In this sense, the term mechanical is deemed to include all methods other than manually changing the device this includes, pneumatic, hydraulic and other devices, including the utilization of servo motors.

Referring now to FIG. 3, a detailed view of the roll-forming assemblies 34, 36, the upper and lower arbors 18, 20, and the driving rolls 28, 30, 38, 40 are shown. In use, a piece of material is pushed through the device by drive rollers 28, 30, 38, 40. As this material passes through the roll-forming assemblies 34, 36, material is variously deformed to form desired shapes and pieces. A locking device 80 releasably selectively holds the adjustable shaft portions 16 of the roll-forming assemblies 34, 36 in a desired orientation when contacted by a piece of material.

As shown in FIG. 3A, in the preferred embodiment, the locking device 80 is made up of a releasably insertable pin 84 which is configured for placement within any one of a plurality of apertures defined within the adjustable pivotable shaft 16. The pin 84 is held in a desired position by a spring 86, such as a century spring, which is encased within a housing 82. The housing 82 is configured to allow slideable displacement of the pin 84 within the housing 82. As the pin 84 is pulled back inside the housing 82, the pin 84 is withdrawn from its position within one of the compatibly configured apertures within the shaft 16. This allows the shaft 16 to rotate to another position and to be selectively held in that desired position by the pin 84. While this sliding-pin type of locking device 80 is shown as being the preferred embodiment, it is to be understood that the invention is not limited thereto but may be variously embodied to include a variety of other types and styles of locking devices for preventing rotation of the device.

The movement of the locking pin 82 may be accomplished by a variety of devices. In addition to manual manipulation of the pin 82, the pin may be displaced by a pneumatic or hydraulic cylinder to which the device is connected. This cylinder may be activated by a control device that selectively engages and removes the locking pin according to a desired protocol. In some embodiments, the locking pin mechanism may be utilized in conjunction with the rotary sprocket 88 that is shown in FIG. 2.

The present invention provides a variety of advantages. The generally horizontal movement of the first and second assemblies 34, 36 along the upper 18 and lower 20 arbors is accomplished by engagement and variation of the horizontal positioning devices 26. In the preferred embodiment, the generally horizontal positioning devices 26 are threaded bolts that are configured to interact with a compatibly threaded portion of the stands or stanchions 22, 24. By providing a rotary force to these bolts, the bolts interact with the stands or stanchions 22, 24 to extend or retract the forming devices toward or away from the stands or stanchions 22, 24 from whence the forming assemblies 36, 38 extend. The horizontal movement of these devices, together with the movements of all of the other pieces of this invention, can be performed either manually or mechanically. A variety of mechanical control types of devices can be utilized, including computerized, electronically signaled devices such as servo controls as well as other types of controls.

Vertical movement of the aperture forming portions of the device is provided by variously raising and lowering the arbors 18, 20. This may be done in a variety of ways, including the utilization of a yoke 32 that holds the arbors 18, 20 in a desired vertical position and raises and lowers the arbors 18, 20 according to the needs of the users. As the arbors 18, 20 are variously raised and lowered, the upper and lower portions of the adjustable pivotal shaft 64, 66 also separate and slideingly or telescopingly extend and retract along the keyed post 78.

When the upper arbor is raised by the yoke 32, the upper sliding block 42 also moves in a generally upward vertical direction. The upper portion of the adjustable pivotal shaft 64 that is bolted to the upper sliding block 42 also moves upward. The lower portion of the adjustable pivotal shaft 66 is bolted to the lower sliding block that is connected to the lower arbor 20. When the upper portion of the adjustable pivotable shaft 64 is moved upward, it separates from the lower portion of the adjustable pivotable shaft 66 and slides along the keyed post 78. The lower portion of the adjustable pivotable shaft 64 does not move in any vertical direction unless the lower arbor 20 is moved.

By rotationally securing the forming rollers 12, 14 with a securing device 16 as previously described, the forming rollers 12, 14 exert forces upon a piece of material that cause repeatable, relatively uniform bends having relatively the same radius with all gauge selections. This is a significant advantage over conventional, fixed roll-forming systems where the intercept point (the precise angle and area of contact between the forming roller and the material) varies as the thickness or "gauge" of the material varies. In another aspect of the present invention, the top surface location of the pivoting roll assemblies 34, 36 can be varied to compensate for gauge changes. The ability of the present invention to be variously horizontally and vertically adjusted allows the aperture or location where material to be formed to enter between the roll-forming assemblies to be varied to accommodate a variety of types, sizes, and shapes of raw material. The ability of the present invention to adjustably vary the positioning and the configuration of the roll-forming devices allows for the device to be quickly interchangeable so as to allow a variety of different shapes and formations of pieces to be formed from the present invention. While the preferred embodiment is described in the context of pairs of roll-forming devices, each being slideably positioned along an arbor, the invention is in no way limited thereto. Rather, the invention is intended to include a variety of other embodiments as well.

Referring now to FIG. 4, an embodiment of the invention is shown wherein a plurality of the multi-axial roll-forming apparatuses are configured in a sequential alignment so as to produce pieces and shapes of a desired type. In this embodiment, a piece of material 104 is fed into the plurality of multi-axial roll-forming apparatuses 10 by a strip feeder assembly 102. As this material enters into a first multi-axial roll-forming apparatus, the drive rolls 28, 30, 38, 40 turn and force the piece of material 104 against the forming devices 34, 36.

The forming devices 34, 36 form a desired bend or deformation into a portion of the material. In this preferred embodiment, a piece of material will pass through fourteen or more of these configurations before exiting the assembly line. Each of these bending configurations, or passes as they may be called, performs a varied function to the piece of material passing through and cumulatively produce a piece having the desired shape and characteristic(s). In order to facilitate such an action, the positioning of the devices 10 along the base 50 may be variously spaced.

The present invention provides a significant advantage in that the configuration of each of the devices may be variously changed according to the needs of the user. In as much as the present invention allows such changes to be made in a relatively quick manner, efficient, and precise manner, a plurality of the devices in the present embodiment could be employed and controlled by an automated system to produce pieces in alternatingly varied positions, which allows for an increased variety of types of pieces that can be formed as well as producing pieces in one line that would ordinarily require two or more lines to produce. This invention also allows pieces to be produced in a pre-stacked orientation, or to be fastened or otherwise connected by additional pieces of machinery. Examples of some of the types of pieces that can be formed by the present invention are found in FIG. 5.

Referring now to FIG. 5, a variety of pieces are shown. As is shown, the present invention may be variously configurable so as to allow a variety of pieces having various cross-sectional forms to be manufactured. Of particular importance and distinction are pieces identified as 210, 212, 216, and 224, which cannot be formed in the prior art types of forming devices. In most of the prior art types of devices, a roll-forming machine must be configured to make either hat type sections, as are shown in as 210, or C-type section as are shown as 214.

A modified C-hat shape, such as the shape shown as 212, was simply not formable with most prior art types of devices because such a configuration would require that the apertures be moved and modified in a variety of ways so that the formed pieces would not be crushed by the drive rollers as the pieces is moved through the device. In order to accommodate the drive rollers, the device would have to be modified into such a position that the device could no longer be functional. However, the present invention is selectively configurable so as to allow the position of the drive rollers and the forming rollers to be alternatively engaged and disengaged from contact with the piece of material as it is formed within the device.

The formation of each of the various types of pieces that are shown in FIG. 5 are reflected in various modifications and variations that can be made to the multi-axial roll-forming devices 10. Depending upon the necessities and desired of the party utilizing the device, the configuration of the various multi-axial roll-forming devices 10 may be altered and varied to produce a variety of pieces having various shapes, designs, thicknesses, and widths. One of the particular advantages of the present invention is that it allows a party to variously efficiently modify the configuration of the roll-forming device to achieve a variety of pieces having varied and necessary characteristics. The configurations may be made manually or automatically and may be coordinated by a programmable logic controller or other device to provide a variety of parts and pieces in an efficient manner.

In one embodiment of the present invention, the configuration of the multi-axial roll-forming device is configured to make so called eave struts or eave beams as are shown as 230 in FIG. 5. In such an embodiment, the present invention would be modified so as to include a variety of multi-configured forming rolls along a single roll-forming portion. Such a configuration would allow a party to dial the pitch or other dimension of the piece to be formed. Such a selection would move a designated or desired forming head in contact with the material passing through the device and make the desired bends in the device. Such a configuration could also be utilized to create desired over bends in the material.

In one embodiment of the present invention, the configuration of the multi-axial roll-forming device is configured so as to form pieces in a stacked configuration such as the configuration shown as 216 in FIG. 5. In order to make these shapes in a stacked orientation, as shown, the multi-axial roll-forming devices 10 must be configured to perform the following steps. First, the first and second roll-forming assemblies 34, 36 are configured and positioned to contact the sheet material 102 at a variety of various desired set points so as form the various desired folds within the material. In the preferred embodiment 14, multi-axial roll-forming devices are positioned and aligned so that as the sheet material passes through the device. Thus, the piece of material is progressively bent to form the piece having the desired structure. These set points are configured so as to form the generally C-shaped pieces oriented in a first direction. For example, an orientation with an open portion of the C-shape facing up. When these contact points have been positioned within the device, the material is fed into the device in a feed direction and the piece is formed in a first orientation having the open portion of the C-shape facing up.

As the material being formed into the first piece passes a desired location in the line forming process, a sensing device signals that a desired portion of the piece being formed has passed a desired location. A sensor senses that a portion such as the tail end of the material sheet has passed a desired location. This may be done by an actual sensor, such as a laser sensor, or may be done by a timer that correlates the positioning of the material sheet in accordance with the rate at which the material is being fed through the device. The first piece continues through the process along the assembly of roll-forming devices continually being formed into the desired shaped piece. In the case of the piece shown as 216 in FIG. 9, this first preferred piece is a generally C-shaped piece having the open portion of the C-shape directed in an upward direction.

Once the end of a piece of material has been sensed at a desired location, an indicator signals the upstream portion of the multi-axial roll-forming apparatus to alter its configuration so as to form a second piece which is similar in shape to the first piece but oriented in a direction opposite to the direction of the first piece. In the case of the piece indicated as 216 in FIG. 5, this is a generally C-shaped piece having the open portion facing downward. This signal to reconfigure is sent to all of the parts of the assembly through which the first piece of material has passed, but is not sent on to the parts of the assembly that still have to process the first piece of material. In order to accommodate this function, various sensors may be positioned at various locations along the forming path. After the first piece of material has passed through a portion of the assembly and has been sensed by the sensor, the portions of the assembly that exist upstream of the sensing point are configured to form pieces in an orientation opposite to the orientation of the piece which was previously formed and passed through.

When this occurs, the multi-axial roll-forming devices through which the first piece of material has already passed are reconfigured to form a second piece of material in a second shape and in a second orientation. This is done by adjusting the pivotal roll-forming assemblies by rotation to vary the roll-forming portions that come into contact with a piece of material. The size of the apertures and the position of the drive rollers can also be horizontally and vertically adjusted so as to arrive at and achieve a desired configuration for allowing passage of a second sheet of material there through. The second piece of material that passes through the device is shaped and oriented to be different from the shape and orientation of the first. In this case, the second piece is formed into a generally C-shaped piece having an open portion facing downward. When the second piece reaches the end of the forming assembly, it is ultimately placed upon the first shaped piece in a stacked configuration as is shown as feature 216 in FIG. 5. In one preferred embodiment, the forming assembly production line as shown in FIG. 4 are also connected to a variety of stacking devices so as to allow the stacked pieces to be accumulated, stacked, banded, and prepared for shipping directly from the production line without additional steps and without the requirement of additional storage space.

A variety of modifications to the aforementioned method can be made. For example, the sensor and indicator functions could be configured so as to sequentially modify the individual multi-axial roll-forming assemblies as pieces of material pass through the assemblies. In other configurations, the multi-axial roll-forming assemblies could be controlled in groups or gangs so as to modify the shape and configuration of the roll-forming assemblies. While in one embodiment the assembly of the various multi-axial roll-forming devices is configured to be located in a place and variously adjusted and configured and reconfigured to achieve desired results, it is to be understood that the present invention is not limited thereto but has been variously configured to achieve a variety of desired results. Such additional configurations include configurations wherein the multi-axial roll-forming assemblies can be slid into and out of position along the forming conveyor line, or where the roll-forming assemblies have multi-headed roll-forming apparatuses and tools.

Figure 11:
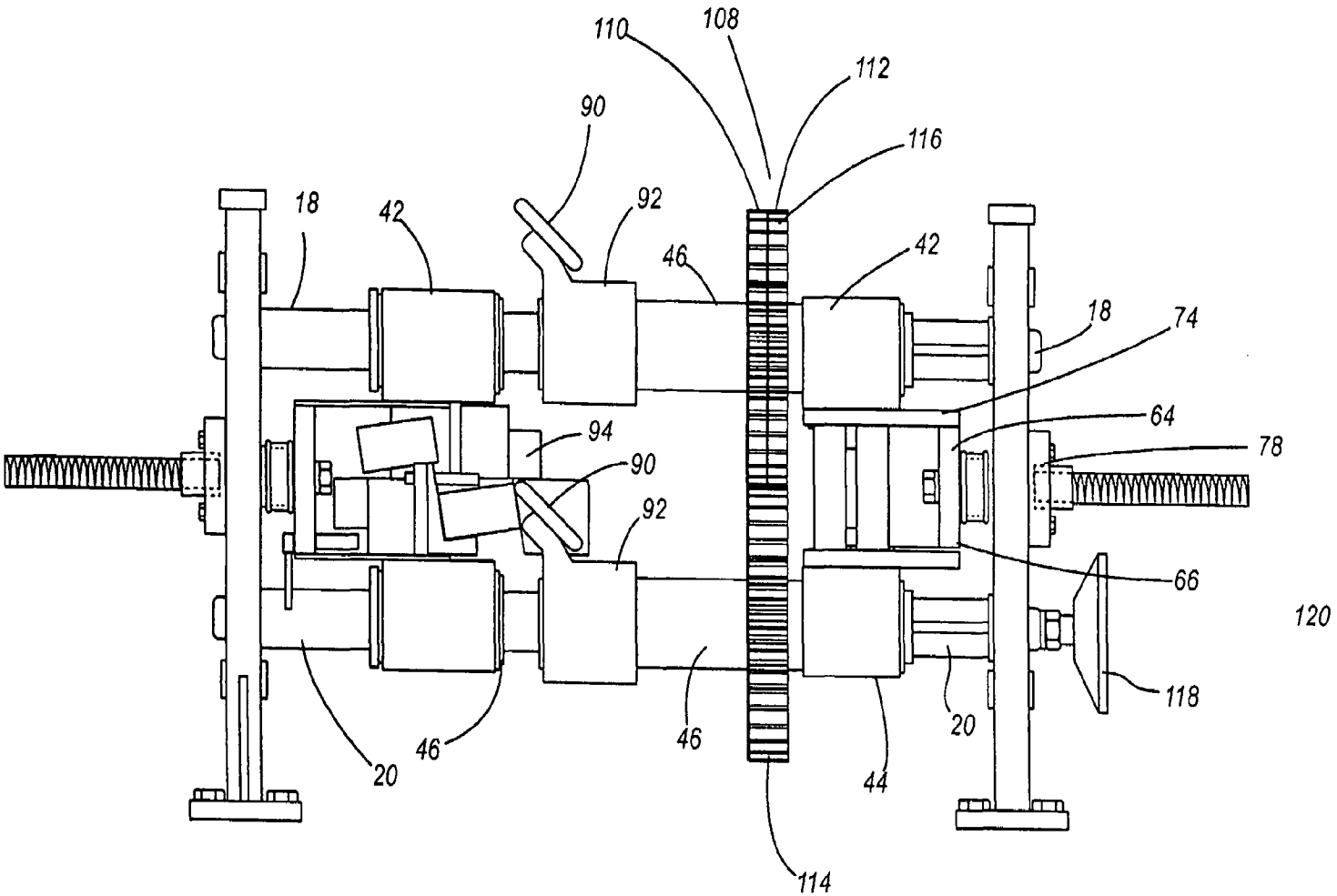
FIG. 11 is a detailed end view of a straightener device shown in FIGS. 4 and 4A.

The individual modifications to the forming process can be varied according to the type of pieces to be formed and the desires and necessities. It should be understood that the present invention provides a plurality of advantages and is not limited to those advantages that are set forth in the present description. In some applications, the material passing into the device is pre-punched or pre-configured in other ways, prior to entry into the forming portion of the device. In addition to utilizing preformed or pre-configured pieces in the device, a variety of other devices may be integrated with the forming device to achieve a desired result. For example, utilizing pre-punched pieces together with a riveting device allows the production of pieces such as pieces 224 and 228 shown in FIG. 5. Additionally, combination of a straightener device as shown in FIG. 11 and a specially configured multi-tooled roll-forming device as shown in FIG. 12 allow the creation of eave struts as are shown as 230 in FIG. 5.

This piece is formed by the formation of a first hat section oriented in a first direction from a piece of material that has pre-positioned apertures located along its outer flanges. A second piece having the configuration of a second hat section, but which is oriented in a second direction is also then formed from this same of material having pre-punched holes. An aligning device is configured to align the apertures from the first piece and the apertures from a second piece. Once the pieces are aligned, a fastening device such as an automated riveting device is utilized to connect the first piece and the second piece together to form the piece shown as 224 in FIG. 5 of the present invention. In other circumstances a piercing riveter could also be utilized.

In other configurations of the preferred embodiment, the multi-axial roll-forming devices may be configured so as to not contact the pieces of material being passed through the device or may be variously embodied in other ways to achieve desired results. For example, in some embodiments, the individual assemblies could be configured to alternatively withdraw and then reenter the path that the material follows through the assembly. This withdrawal and reentry could be performed in a variety of ways including pulling out or swinging out opposing assemblies to form or prevent certain formations from occurring. The assemblies could also be configured to work the pieces of material from the outside in thus preventing the formation of lip structures when such structures are not wanted. It should also be noted that among the advantages that the present invention provides is the ability of the devices described in the invention to form both hat shaped pieces as shown as 210 in FIG. 5, as well as C-sections shown as 214 shown in FIG. 5. This is a significant advantage over the prior art devices and methods which do not allow for such a configuration to take place.

While the configuration as shown is the preferred embodiment in that it provides multi-axial modification and frame configurations as well as bilateral roll-forming assembly modifications, it is to be understood that the invention is not limited there to but may be variously embodied in other embodiments such as those embodiments where only one arbor is moveable, only one roll-forming assembly is modifiable, or where only one side of the horizontal driving rollers is movingly slideable in a desired direction. A variety of these types of embodiments are shown in the attached FIGS. 6, 7, 8, 9, 10, and 11.

Figure 6:
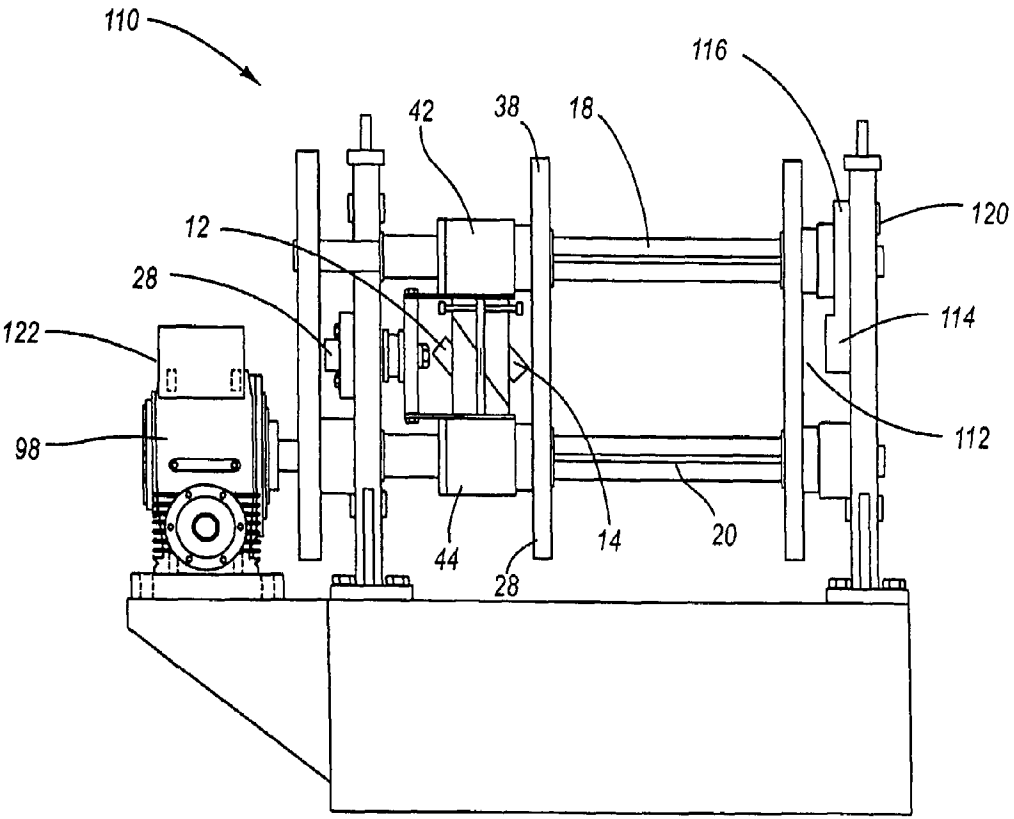
FIG. 6 is an end view of a second embodiment of the present invention.

FIG. 6 illustrates another embodiment of a roll-forming station 110 constructed in accordance with the principles of the present invention. A single idler roll 112 is mounted on a retainer plate 114. The retainer plate 114 has an idler shaft-receiving portion 116. The retainer plate 114 is mounted on a yoke assembly 116, mounted in turn on a stand assembly 120. In this embodiment, the idler roll 112 is capable of vertical adjustment, to accommodate adjustment of the yoke assembly 116 for different material gauges. The embodiment shown in FIG. 6 is used when edge portions of the rolled material is meant to be rolled in one direction only (here downwardly), as there is no adjustable pivoting mechanism on this side to accommodate changes in the configuration of the device. On the opposite side, a gearbox 122 driven by a motor 98 is used to effect adjustment of the roll-forming assembly 124 in a manner similar to that described with reference to FIG. 1.

Figure 7:
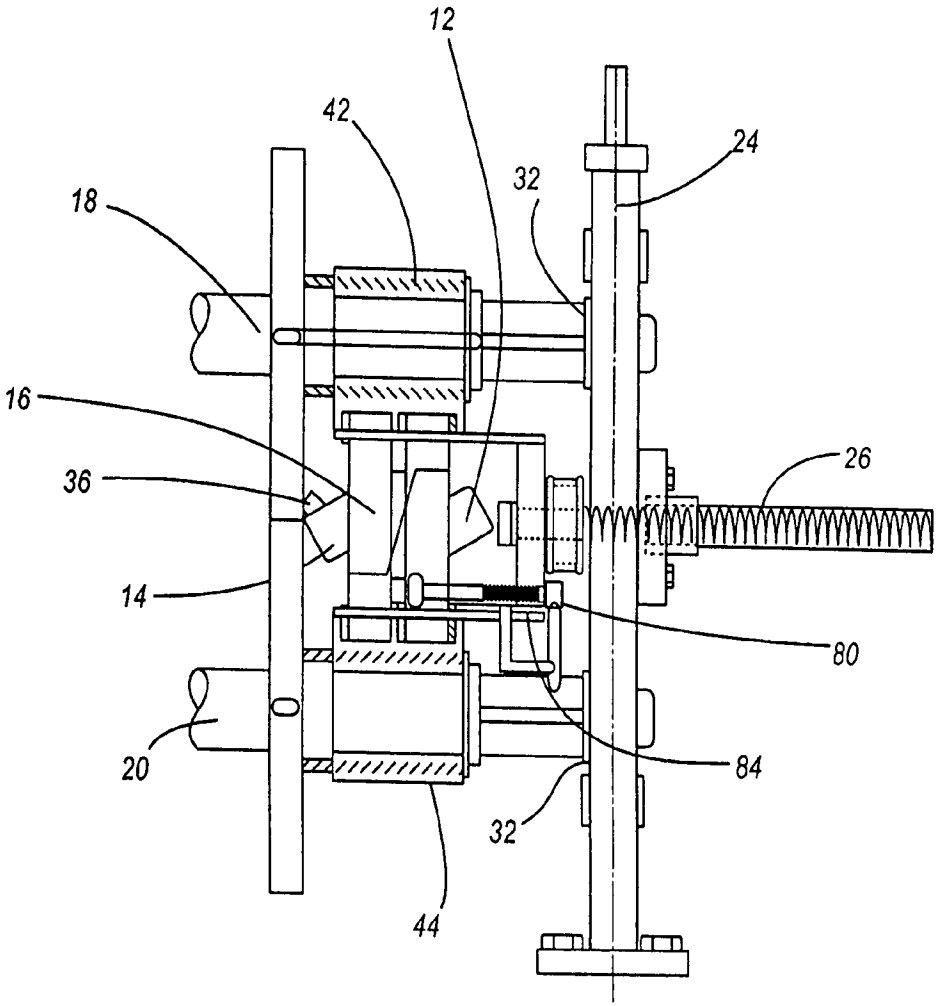
FIG. 7 is an end view of a third embodiment of the invention.

FIG. 7 shows a detailed front view of an embodiment of the invention wherein the locking device 80 for locking the pivotal roll-forming assemblies 34, 36 is a threaded indexing pin 84. This threaded indexing pin 84 is principally configured for use in operations wherein the setting and adjustment of the pivoting roll-forming assembly 36 is performed manually rather than automatically, however this arrangement may also be modified for use with an automated device. The threaded indexing pin 84 is configured to interact with a portion of the horizontal positioning device 26 so as to allow the pin 84 to extend into and retract out of a portion of the adjustable pivotable shaft 16. This movement releasably secures the pivot shaft 16 in a desired position and prevents the shaft 16 from moving when the forming rolls 12, 14 are contacted by a piece of material passing through the device 26.

Figure 9:
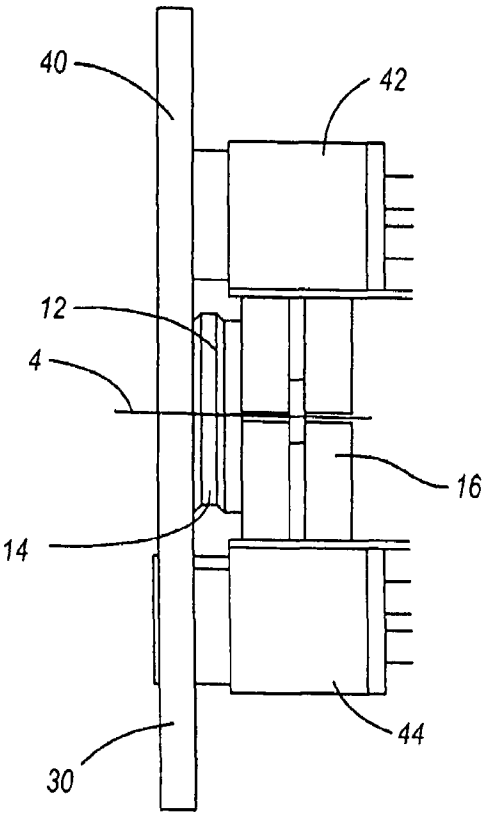
FIG. 9 is an end view of a fifth embodiment of the invention.
Figure 8:
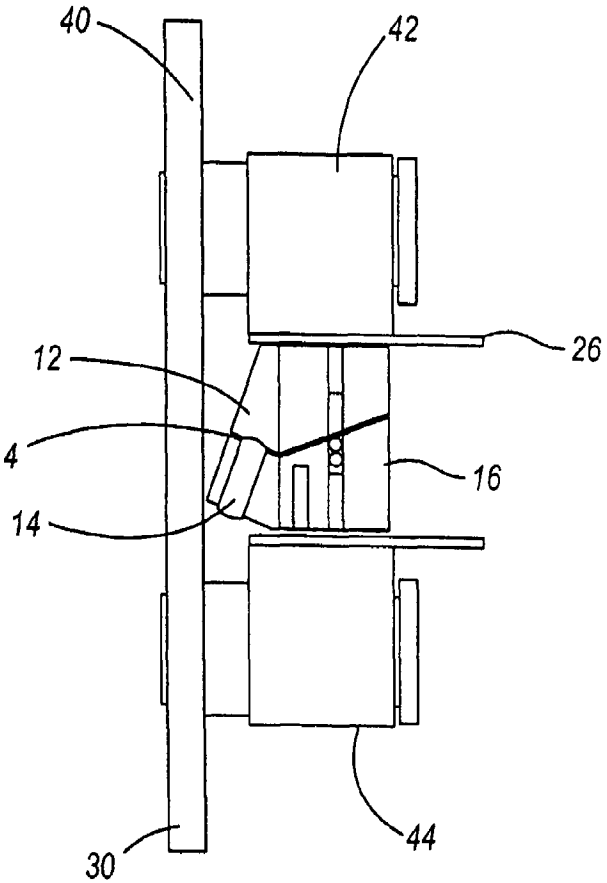
FIG. 8 is an end view of a fourth embodiment of the invention.

FIGS. 8 and 9 show embodiments of the present invention wherein the roll-forming devices 12, 14 are configured to act upon a piece of material 4 by applying force from both a top position and a bottom position in order to form pieces that have a desired shape. Referring first to FIG. 8, a detailed front view of one embodiment of the invention is shown. In this embodiment, the first and second forming rolls 12, 14 are connected to the adjustable pivotable shaft 16 in such a direction and orientation so as to form complimentarily configured pieces. These forming rolls 12, 14 are then each configured to allow passage of a piece of material 4 between the first and second forming rolls and to form the pieces of material 4 into desired shapes based upon the dimensions of the forming rolls 12, 14. The ability of the upper 64 and lower portions 66 of the adjustable pivotable shaft 16 to vertically separate allows the positions of the first and second forming rolls to be maintained in a relatively stable location upon the material being passed by the roller regardless of the thickness or gauge of the material being formed. This allows for increased precision in forming pieces because the position of the forming rolls 12, 14 upon the piece of material being formed is the same regardless of the thickness of the material.

FIG. 9 shows a variation of the embodiment shown in FIG. 8 wherein the configuration of the first and second forming rolls and the adjustable pivotable shaft are configured to allow passage of sheets of material 4 along a generally horizontal plane. An example of a piece formed by such an embodiment is shown as feature 226 in FIG. 5.

Figure 10:
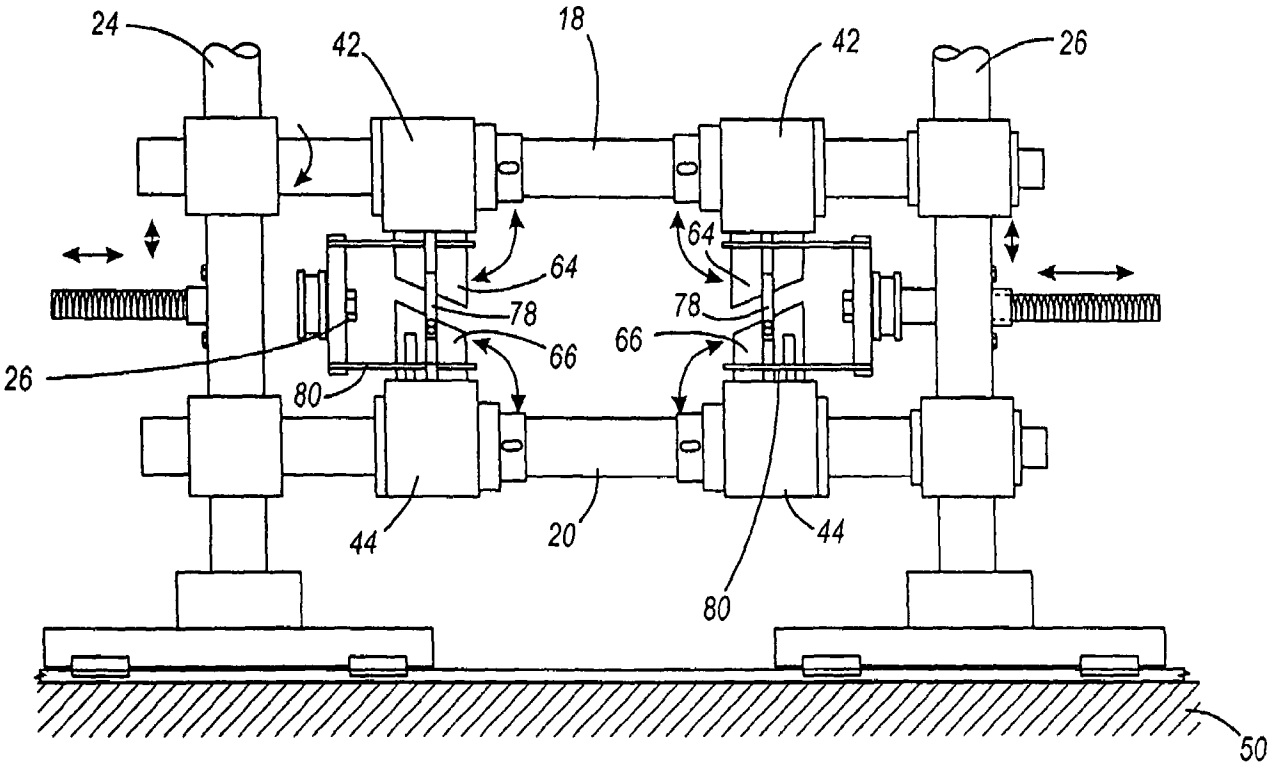
FIG. 10 is an end view of a sixth embodiment of the invention.

FIG. 10 shows an alternative embodiment of the present invention wherein the shaft-locking device 80 is positioned to intersect a lower portion 66 of the adjustable shaft 16 from a location within the lower sliding blocks 44. The upper and lower sliding blocks 42, 44 are configured to be placed around sleeves 46 which are keyed for connection with the upper and lower arbors 18, 20. These sleeves 46 when keyed in a desired location rotate with the respective arbor to which they are attached. The upper and lower sliding blocks 42, 44 are configured to attach around the sleeve 46 in a clamshell like configuration and thus allow the sleeve therein to rotate while the upper and lower sliding blocks 42, 44 do not rotate. Preferably, this is done by locking a portion of the sliding block 42, 44 on the shoulder portion 56 that are connected to the slideable sleeve.

FIG. 10 also shows the feature of the present invention wherein the upper 64 and lower 66 portions of the adjustable pivotable shaft 16 are extendible vertically, and where the orientation between the arbors 18, 20 and the surface of the adjustable shaft upon which the forming rollers 12, 14 are attached are configured to be separated by about 90 degrees.

FIG. 11 shows a configuration of the present invention wherein the roll-forming portions 12, 14 of the multi-axial roll-forming assembly are configured to allow portions of the pieces being formed to be straightened or over bent, such a section is called a straightener section 106. In addition to providing assistance with producing a desired shape, such a configuration also enables the device to accommodate pieces having various yields. These straightener sections 106 do not have drive rolls 28, 30 to facilitate the passage of material through which the straightener section 106 will pass. As a result, the straightener sections 106 are generally configured for placement between passes or sections 10 that are configured to pass the piece of material through the device 10. This placement allows material to be fed through the straightener sections 106 by the drive rolls 28, 30 which are positioned upon the multi-axial roll-forming devices that are located upon either side of the straightener sections 106. The typical position and placement of straightener sections 106 in a line of continuous roll-forming passes is shown in FIGS. 4 and 4 A.

Referring now back to FIG. 11, the straightener sections 106 in this configuration are comprised of a pair of straightening rollers 90 that are connected to sliding blocks 92 which are then connected to the sliding sleeves 46. An angled roll-forming tool 90 is connected to sliding block 92. The angled roll-forming tool 90 is connected to the sliding block 92 and is configured to work in conjunction with a support roll 94, or another forming roll 14 to obtain a desired shape in a section of the piece such as a corner. Depending upon the exact modifications and allowances that are desired, the configuration of the straightener section 106 can be modified as desired. For example, by modifying the arrangement of the roll-forming portions 12, 14 and the location and placement of the pieces as they pass through the device, the straightener section 106 can be configured to work the corners of the piece in either the web to flange, lip to flange, or lip to web configurations.

The angled form rollers 90 are configured to connect to arbors 18, 20 through the sliding blocks 92, and sliding sleeves 46 in a manner which is very similar to the way that the roll-forming assemblies 34, 36 are connected to the arbors 18, 20. Such a configuration allows the angled form rollers 90 to be positioned in a variety of horizontal positions along the arbors 18, 20. The angled rollers 90 are adjustably securely held in a desired orientation with regard to the arbors 18, 20 by an upper gear wheel assembly 108 and a lower gear wheel assembly 114. The upper gear wheel assembly 108 is comprised of a first upper gear wheel 110 and a second upper gear wheel 112. Both the upper gear wheel assembly 108 and the lower gear wheel assembly 114 are configured to have a plurality of teeth 116. The first upper gear wheel 110 and the second upper gear wheel 112 are configured to be bolted together in an orientation wherein the combination of the first upper gear wheel 110 and the second upper gear wheel 112 can be adjusted and locked into a desired position. The teeth 116 of the first upper gear wheel 110, and the teeth 116 of the lower gear wheel assembly 114 interact to prevent twisting of the angled form roller assemblies in a first direction. The teeth 116 of the second upper gear wheel 112 and the teeth of the lower gear wheel assembly 114 interact to prevent twisting of the angled form roller assemblies in a second direction. In addition to holding the angled forming wheels 90 in a desired orientation and position, this feature prevents the material passing through the device from backlash against the direction of material passage through the device.

The positioning of the angled rollers 90 can be variously adjusted according to the necessities of the user through an adjustment wheel 118 that is held in place by a locking nut 120. This adjustment turns the lower gear wheel assembly 114, which in turn rotates the upper wheel assembly 108 and the position of the adjustable rollers 90. When a desired position has been arrived at, the adjustment wheel can be locked in place by a locking nut 120. In other embodiments, modification of the position of the angled rollers may be accomplished by a gear motor which is connected to a coupling which replaces the adjustable wheel 118. In either an automated or a manual method, a proximity switch would allow for the precise location of the adjustment rollers 90 to be obtained.

In these straightening sections 106, the first and second forming rolls 12, 14 are dual support rolls that are configured to support the top and side portions of a flange while the angled forming portions 90 work the corners or other portions to provide the desired or selected amount of over bending. Similar to the other embodiments, in this embodiment the horizontal positioning of the angle roll formers 90 and the first and second roll formers 12, 14 can be variously adjusted by a horizontal positioning device 26, such as a threaded rod. In this embodiment, the angled rolls 90 are shown as being 180 degrees out from one another. This is only one illustrated embodiment and it is to be distinctly understood that the angled rolls 90 can also be variously configured and combined for a variety of other configurations as long as the frame allows the aperture to be sufficiently modified to accommodate the rotation of the angled form rollers 90.

Figure 4A:
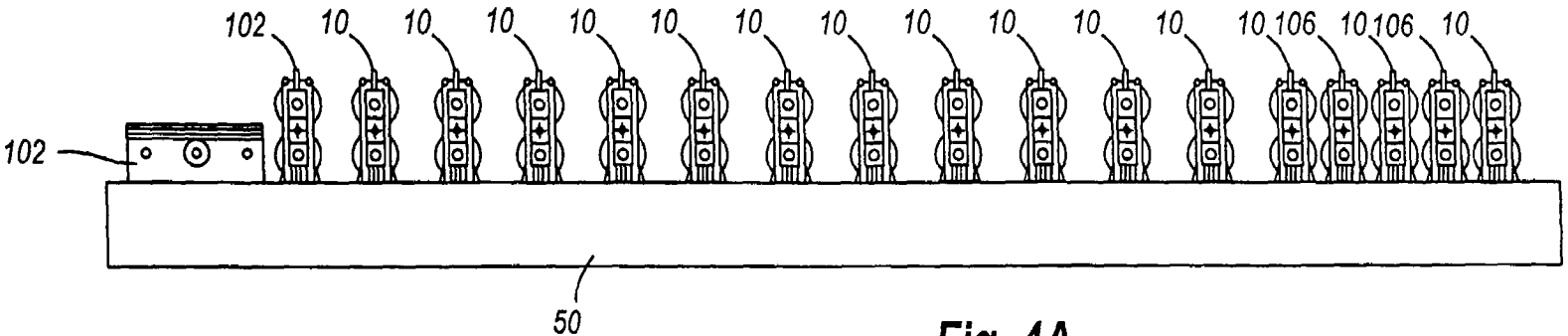
FIG. 4A is a side view of the embodiment shown in FIG. 4.

The various embodiments shown in the present invention can be variously combined to manufacture pieces and parts that have the desired shapes, features, and orientation. As shown in FIGS. 4 and 4A, by combining various configurations of the multi-axial roll-forming apparatuses 10, assemblies can be put together which form a variety of desired shaped parts. Examples of such desired shaped parts are shown in FIG. 5.

The present invention also provides individuals multi-axial roll-forming apparatuses that provide a fast and effective mechanism for producing a variety of profiles that heretofore required expensive and time-consuming tool change and material handling steps. In addition to these previously stated advantages, the present configuration allows for such rapid and precise changes to be made that is possible for roll-forming assemblies to be configured to form pieces in alternating directions as frequently as upon a piece by piece basis. This allows the pieces to exit the final end of the assembly line having to stack or nest upon one another. This provides an advantage that was previously unavailable in the prior art.

For example, it is often desirable to form a profile by bending the edge portion and flange down on both sides of the material, then up on both sides alternately. "C" shapes are typically stacked one inside the other as they are produced, either manually or automatically. In conventional roll-forming systems, the flanges are always formed downwardly, and then stacking will require that every other part to be flipped 180 degrees in order to nest the pieces inside of one another. By contrast, the present invention permits the bending of both edge portions upwardly up for the first part or component, and down for the second component. This facilitates ease of stacking "C" components one inside each other as they as they exit the roll former, thus eliminating flipping every other piece as required in the prior art. This provides a significant advantage in that it eliminates the additional processing step of manually flipping the formed pieces in order to stack them. In addition, such a configuration may be interconnected with a variety of stacking, banding and transporting devices as are shown below.

FIG. 12 shows another modification of a first roll-forming device 12. While this description is set forth in the context of showing a first roll-forming device, it is to be distinctly understood that the invention is not limited thereto but may also be variously embodied to include a variety of other features and forming devices. The roll-forming device shown in FIG. 12 further includes a variety of other forming rollers that are configured to interact with a piece of material being fed through the machine to form a desired shape.

FIG. 12A shows an embodiment of the present invention wherein the roll-forming device shown in FIG. 12 is combined with one of the straightener fixtures of FIG. 11 to produce the eave-strut type pieces shown as piece 230 in FIG. 5.

Figure 13:
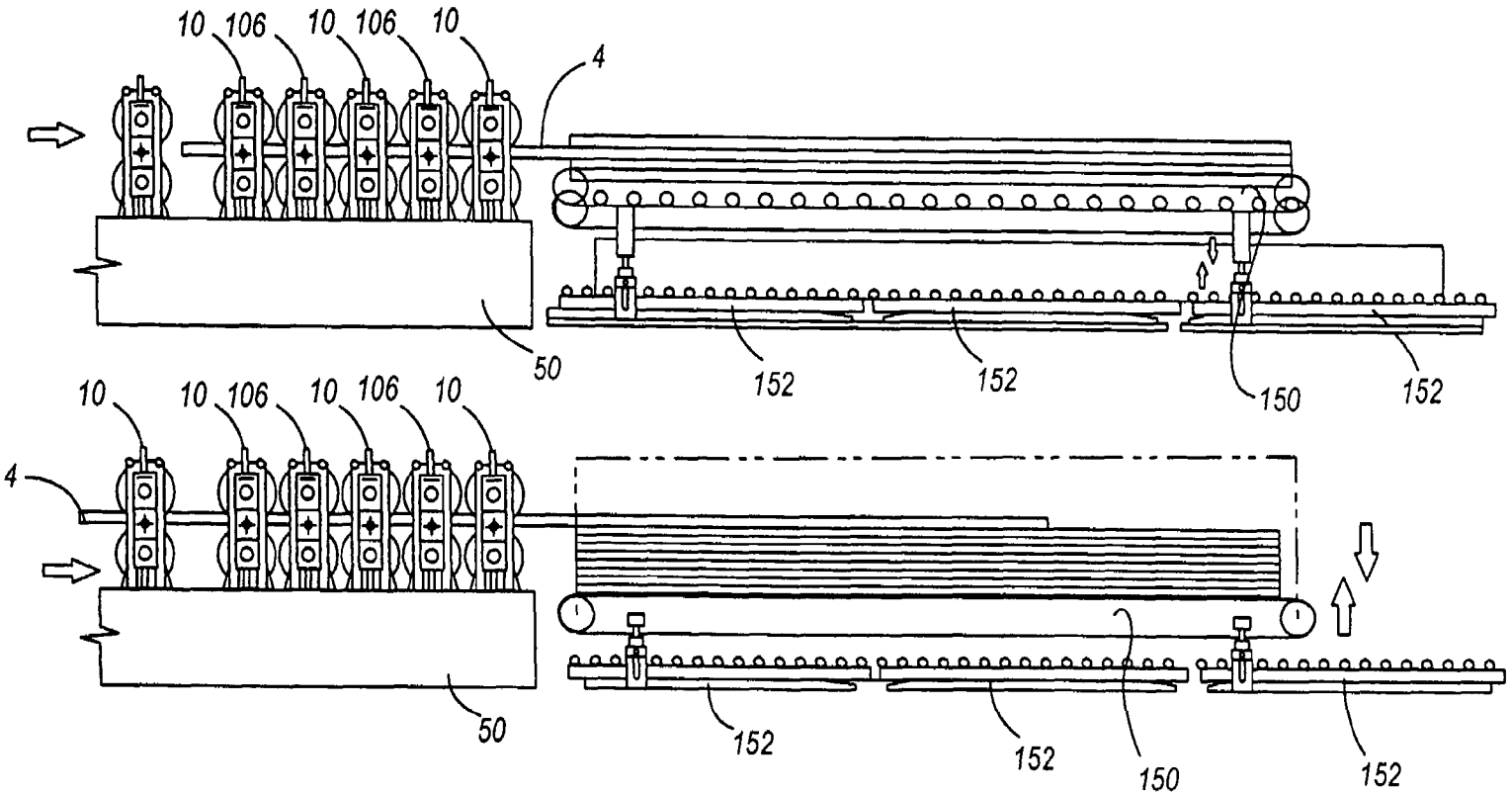
FIG. 13 is a perspective view of an embodiment of the invention wherein the roll-forming assembly that is shown in FIG. 4 is further configured to stack pieces after they pass through the device.
Figure 14:
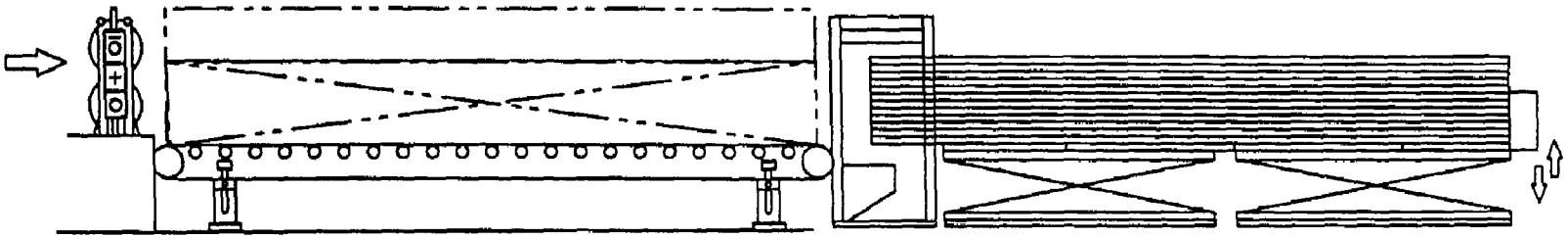
FIG. 14 is a side view of an embodiment of the present invention including a positioning device and a scissors lift conveyor.
Figure 15:
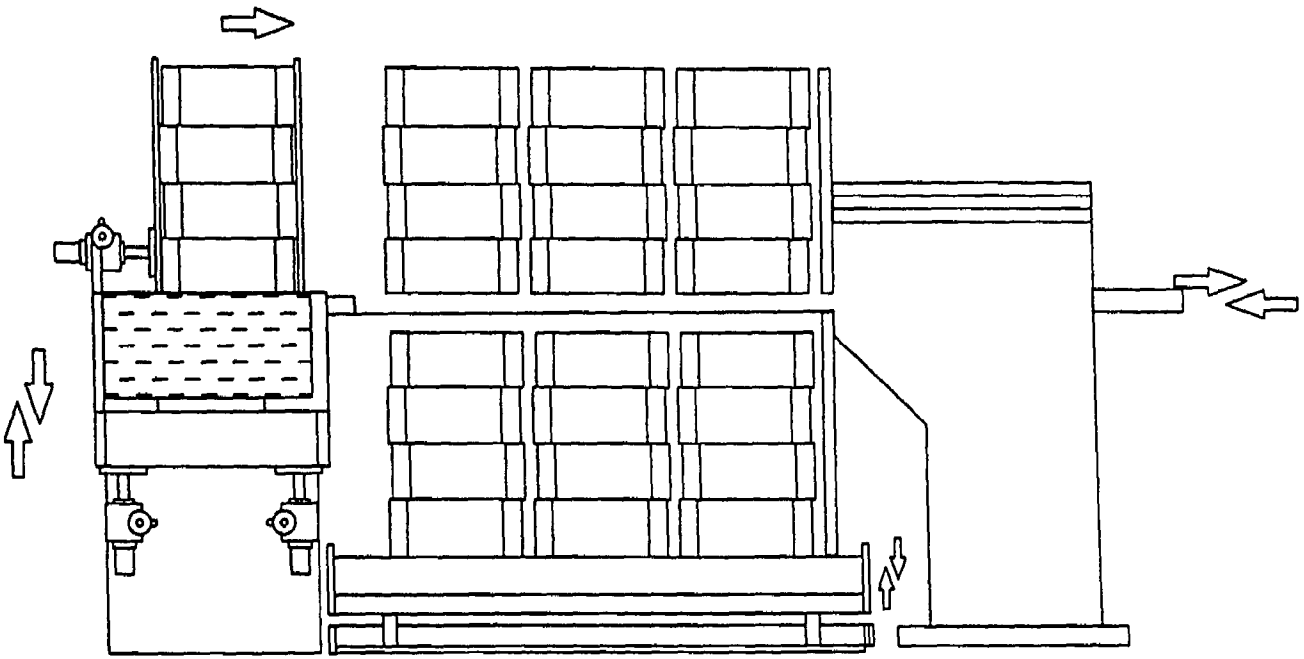
FIG. 15 is an end view of an alternative to the embodiment shown in FIGS. 13, and 14.

Referring now to FIGS. 13, 14, and 15 of the present application, an embodiment of the present invention is shown wherein the stacked pieces 4 exiting the assembly of multi-axial roll-forming devices are placed upon a stacking conveyor assembly 150. Referring first to FIG. 12, as the pieces 4 reach the end of the assembly line, the first pieces 4, which are oriented in a first direction, are placed upon a down stacking conveyor 150. This down stacking conveyor 150 is configured to maintain the first piece in a first desired elevated position when placed upon the conveyor 150 and to maintain this first piece this position so that a second piece exiting the assembly will stack or nest inside the first piece. When such an arrangement is accomplished, the elevated conveyor is configured to lower thus allowing space for additional pieces to be sequentially stacked upon a desired location. These additional pieces are then sequentially stacked until a desired number of pieces is obtained.

Once this desired number of pieces is obtained, a series of scissors lift conveyors 152 having a series of rolling wheels attached rise up and lift the stack of pieces off of the stacking conveyor and transport the stack of pieces to another location. This is shown in FIG. 13 of the present invention. In one embodiment, pieces are brought to an in-line bander 154, which binds the stacked pieces into a bundle. These bundles are then transported to another device such as a pallet stacker or other device, which further combines the bundles for shipment or storage. A variety of modifications to this basic embodiment may also be utilized including embodiments where the individual stacks are pushed with a device such as a positioning device into a bundle and this bundle is then banded and sent to a pallet stacker or other similar device.

An end view of such an embodiment is shown as FIG. 15. In addition to these features, the application of the present invention utilizing the stacking and banding configurations can also be variously embodied for use with other pieces, and shapes formed by the present invention.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A multi-axial roll-forming apparatus configured to variously adjust to form a variety of selected components from a sheet of material said multi-axial roll-forming apparatus comprising:

a first contacting member configured to deform a portion of said sheet of material in a first direction; and a second contacting member configured to deform a portion of said sheet of material in a second direction, said first contacting member connected to said second contacting member through a securing mechanism, said securing mechanism configured to be extendable, retractable and adjustably selectable so as to provide a variety of distances between said first contacting member and said second contacting member and allow a user to select a desired contacting member to deform a portion of said sheet of material in a desired direction.

2. A multi-axial roll-forming apparatus configured to variously adjust to form a variety of selected components from a sheet of material, said multi-axial roll-forming apparatus comprising:

at least one vertically adjustable arbor;

a first contacting member configured to deform a portion of said sheet of material in a first direction; and a second contacting member configured to deform a portion of said sheet of material in a second direction, said first contacting member connected to said second contacting member through a securing mechanism, said securing mechanism horizontally slideably attached to said arbor; said arbor configured to allow vertical positioning of said first and second contacting members in any one of a variety of chosen vertical positions.

3. The multi-axial roll-forming apparatus of claim 2 further comprising a selective positioning device adapted and configured to facilitate selective adjustment of said first and second contacting members in any one of a variety of generally horizontal directions along said arbor.

4. The multi-axial roll-forming apparatus of claim 2 wherein said selective positioning device is a threaded rod and nut assembly configured to be moved manually.

5. The multi-axial roll-forming apparatus of claim 2 wherein said selective positioning device is a threaded rod and nut assembly configured to be moved mechanically.

6. The multi-axial roll-forming device of claim 2 wherein said first contacting member is positioned in a first orientation and said second contacting member is positioned in a second orientation and said securing mechanism is configured to pivot to select a desired contacting member to deform a portion of a sheet of material.

7. The multi-axial roll-forming apparatus of claim 2 further comprising a first drive roll horizontally adjustably connected to an upper arbor, and a second drive roll horizontally adjustably connected to said lower arbor, said first and second drive rolls defining an aperture there between, said first and second drive rolls configured to engage and force said sheet of material against at least one of said contacting members.

8. A multi-axial roll-forming apparatus configured to variously adjust to form a variety of selected components from a sheet of material, said multi-axial roll-forming apparatus comprising:

a first contacting member configured to deform a portion of said sheet of material in a first direction; and a second contacting member configured to deform a portion of said sheet of material in a second direction, said first contacting member connected to said second contacting member through a securing mechanism, said securing mechanism configured to be adjustably selectable so as to allow a user to select a desired contacting member to deform a portion of said sheet of material in a desired direction;

said securing mechanism is a generally vertically oriented pivoting shaft having said first contacting member connected to a first location and said second contacting member connected to a second location, said pivoting shaft configured to selectively pivot between a first position wherein said first contacting member deforms a sheet of material in a first direction and a second position wherein said second contacting member deforms a sheet of material in a second direction.

9. The multi-axial roll-forming apparatus of claim 8 wherein said pivoting shaft is selectively pivotable by manual manipulation.

10. The multi-axial roll-forming apparatus of claim 8 wherein said pivoting shaft is selectively pivotable by a mechanical device.

11. A multi-axial roll-forming apparatus comprising:

a first roll-forming assembly said first roll-forming assembly having a generally vertically oriented pivoting shaft said pivoting shaft having at least one forming roller connected thereto, said forming roller configured to deform a piece of material in a selected direction to a selected extent; and a second roll-forming assembly said second roll-forming assembly having a generally vertically oriented pivoting shaft, said pivoting shaft having at least one forming roller connected thereto, said forming roller configured to deform a piece of material in a selected direction and to a selected extent;

said first and second roll assemblies generally horizontally adjustably positioned along at least one vertically adjustable arbor, said arbor vertically adjustable to vary the vertical positioning of said first and second roll-forming assemblies, said first and second roll-forming assemblies also horizontally adjustable along said arbor to form an aperture configured to allow passage of a piece of material to be deformed there through;

said pivoting shafts extendible and retractable so as to provide a variety of distances between said first forming roll and said second forming roll.

12. The multi-axial roll-forming apparatus of claim 11 further comprising a vertically restricting device configured to selectively prevent said first and second forming rolls and arbors from separating in a vertical plane.

13. The multi-axial roll-forming apparatus of claim 11 comprising a selective positioning device adapted and configured to facilitate selective adjustment of said first roll-forming assembly in any one of a variety of generally horizontal directions along said arbor.

14. The multi-axial roll-forming apparatus of claim 13 further comprising a selective positioning device adapted and configured to facilitate selective adjustment of said second roll-forming assembly in any one of a variety of generally horizontal directions along said arbor.

15. The multi-axial roll-forming apparatus of claim 11 wherein said selective positioning device is a threaded rod and nut assembly configured to be moved manually.

16. The multi-axial roll-forming apparatus of claim 11 wherein said selective positioning device is a threaded rod nut assembly configured to be moved mechanically.

17. The multi-axial roll-forming apparatus of claim 12 wherein said first and second roll-forming assemblies each contain at least one second forming roller connected to said pivoting shafts, said second forming rollers configured to deform a piece of material in a selected direction and to a selected extent, said first and second forming rollers positioned along said pivoting shafts in such a direction whereby pivoting said pivot shafts in a first direction positions said first forming rollers in a position to contact said piece of material and pivoting said pivot shafts in a second direction positions said second forming rollers in a position to contact said piece of material.

18. The multi-axial roll-forming apparatus of claim 11 further comprising a first drive roll horizontally adjustably connected to an upper arbor, and a second drive roll horizontally adjustably connected to a lower arbor, said first and second drive rolls configured to engage and force said material against at least one of said forming rolls.

19. The multi-axial roll-forming apparatus of claim 11 wherein said pivoting shafts are generally vertically oriented pivoting shafts having said first forming roll connected to a first location and said second forming roll connected to a second location, said pivoting shafts each configured to selectively pivot between a first position wherein said first forming roll deforms a sheet of material in a first direction and a second position wherein said second forming roll deforms a sheet of material in a second direction.

20. The multi-axial roll-forming apparatus of claim 12 wherein said device is configured to form elongated trough sections having a hat shaped cross sectional profile.

* * * * *